US006029571A

United States Patent [19]

Johner et al.

[11] Patent Number: 6,029,571

[45] **Date of Patent: *Feb. 29, 2000**

[54] DAMPENING-UNIT ROLLER OF A PRINTING MACHINE

[75] Inventors: Gerhard Johner, Gelnhausen; Stefan Hasenzahl, Darmstadt; Jürgen Kern, Mauer, all of Germany

[73] Assignees: Heidelberger Druckmaschinen AG, Heidelberg; Coatec Gesellschaft fuer Oberflaechenveredelung mbH, Schluechtern, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/730,372

[22] Filed: Oct. 15, 1996

Related U.S. Application Data

[63] Continuation of application No. 08/518,574, Aug. 23, 1995, abandoned, which is a continuation of application No. 08/089,802, Jul. 9, 1993, abandoned.

[30] Foreign Application Priority Data

| | | | |
|---|---|---|---|
| Jul. 9, 1992 | [DE] | Germany | 42 22 515 |
| Jun. 25, 1993 | [DE] | Germany | 43 21 183 |

[51] Int. Cl.[7] ..... B41L 25/00

[52] U.S. Cl. ..... 101/148

[58] Field of Search ..... 101/147, 148

[56] References Cited

U.S. PATENT DOCUMENTS

| | | | |
|---|---|---|---|
| 3,640,221 | 2/1972 | Wyke | 101/453 |
| 3,901,147 | 8/1975 | Holland . | |
| 3,989,977 | 11/1976 | Ashizaki | 313/468 |
| 4,126,536 | 11/1978 | Balko et al. | 204/296 |
| 4,759,284 | 7/1988 | Haggard et al. | 101/148 |
| 4,869,799 | 9/1989 | de Nora et al. | 204/252 |
| 4,991,501 | 2/1991 | Yokoyama et al. . | |
| 5,004,710 | 4/1991 | Anderson | 501/103 |

FOREIGN PATENT DOCUMENTS

| | | |
|---|---|---|
| 0412219 | 2/1991 | European Pat. Off. . |
| 60248397 | 12/1985 | Japan . |
| 3297647 | 12/1991 | Japan . |
| 1524323 | 1/1976 | United Kingdom . |

OTHER PUBLICATIONS

"Thermal Barrier coating for Jet Engine Improvement", Johner et al., Thin Solid Films, 1984, pp. 301–315.

"Experimental and Theoretical Aspects of Thick . . . ", Johner et al., NTSC '87:Thermal Spray, pp. 155–166.

"Flame rig testing of thermal barrier coatings and . . . " Johner et al., J. Vc.Sci.Tech. 1985, pp. 2516–2524.

*Primary Examiner*—Ren Yan
*Attorney, Agent, or Firm*—Herbert L. Lerner; Laurence A. Greenberg

[57] ABSTRACT

Dampening-unit roller for a dampening unit of a printing machine includes a roller body having an outer cylindrical surface, and a coating on the outer cylindrical surface, the coating including or consisting of an oxide of zirconium and/or an oxide of yttrium.

20 Claims, 2 Drawing Sheets

DAMPENING-UNIT ROLLER OF A PRINTING MACHINE

This application is a continuation of application Ser. No. 08/518,574, filed on Aug. 23, 1995, now abandoned, which was a continuation of application Ser. No. 08/089,802, filed Jul. 9, 1993, now abandoned.

BACKGROUND OF THE INVENTION

Field of the Invention

The invention relates to a dampening-unit roller, such as a metering roller, particularly, of a dampening unit of a printing machine, such as an offset printing machine, in particular, having a coating on the outer cylindrical surface thereof.

The dampening unit of a printing machine, for the most part, has a plurality of rollers serving to apply a dampening film, which is as thin and as uniform as possible, onto a printing form of a printing-form cylinder. A particularly thin and uniform distribution of the dampening medium ensures a good printing result. Moreover, it is essential that infeeding of the dampening medium take place without any diffusion of printing ink into the dampening unit. This diffusion of printing ink is especially critical for arrangements wherein the rollers of the inking unit of the printing machine are connected to the dampening-unit rollers via at least one intermediate roller.

The better the hydrophilic property of the surface of the dampening-unit roller, the thinner and more uniform the application of the dampening filml.

It has become known heretofore to use surface-ground and/or polished stainless steel as surface material for such dampening-unit rollers in order to obtain a surface which is as hydrophilic as possible. Moreover, it has become known heretofore to galvanically deposit on the outer cylindrical surface of a dampening-unit roller a chromium layer which may then be ground and/or polished.

U.S. Pat. No. 4,991,501 discloses a method in which a layer of ceramic material is applied by flame spraying onto a metal roller, the flame-sprayed ceramic layer being subjected to a pore-sealing treatment in order to improve the hydrophilic property thereof. After a predetermined service life, the pore-sealing layer requires re-hydrophilizing.

In order to improve the hydrophilic condition of the surface of the dampening-unit roller, it has also become known heretofore to add alcohol, such as isopropanol or ethanol, for example, and/or alcohol substitutes to the dampening water. For the purpose of protecting the environment and in view of future legislation and regulations, respectively, a reduction in the use of alcohol is urged. Yet, there remains a demand, nevertheless, for top-grade prints for which an extremely thin and uniform layer of dampening medium is a prerequisite.

SUMMARY OF THE INVENTION

It is accordingly an object of the invention to provide a dampening-unit roller of the type initially mentioned in the introduction hereto having outstanding hydrophilic effects even when no or only little alcohol has been added to the dampening medium.

With the foregoing and other objects in view, there is provided, in accordance with the invention, a dampening-unit roller for a dampening unit of a printing machine, the roller comprising a roller body having an outer cylindrical surface, and a coating on the outer cylindrical surface, the coating being comprised of an oxide of zirconium and/or an oxide of yttrium.

Coating a respective roller with a substance or substances according to the invention results in an extremely small contact angle of the dampening medium. The contact angle is the angle formed at a dampening-medium drop by the secant on a drop and a plane surface on which the drop is located. With the coating according to the invention it is unnecessary or hardly necessary, due to the extremely small contact angle, to lower the surface tension of the dampening medium by adding alcohol or the like, because an extremely thin and uniform dampening-medium film is created without alcohol or the like having to be added. Only one of the dampening-unit rollers of the printing machine or a plurality thereof may be coated with the materials or substances in accordance with the invention. It is especially advantageous to provide the metering roller of the dampening unit with the coating according to the invention.

The use of the expressions "comprised of", "containing" and "including" in connection with stated substances or materials of the coating according to the invention in this specification and the accompanying claims is meant to express alternatively that the coating may be made up of one or more other substances in addition to the stated substance or substances or that the coating may be made up exclusively of the stated substance or substances. On the other hand, the term "consisting of" used within the framework of this application is meant to state that the coating is made up of the stated substance or substances only.

In accordance with another feature of the invention, the oxide of zirconium is the substance $ZrO_2$.

In accordance with a further feature of the invention, the oxide of yttrium is the substance $Y_2O_3$.

In accordance with an added feature of the invention, the coating consists of or is comprised of $ZrSiO_4$. This coating may be formed, for example, by dissolving in the $ZrO_2$ crystal lattice an appropriate amount of $SiO_2$, thus forming $ZrSiO_4$ from $ZrO_2$ which is highly stabilized by $SiO_2$. Of course, it is also conceivable to produce the $ZrSiO_4$ coating differently. According to the aforementioned examples it is also possible to introduce a relatively high concentration of the stabilizer MgO, for example, 24 percent by weight, in the form of magnesium zirconate, into the $ZrO_2$ crystal lattice, similar to the case of $SiO_2$ in zirconium silicate. The aforementioned $ZrSiO_4$ has excellent hydrophilic properties.

In accordance with the invention, the coating contains both an amount or fraction of zirconium oxide and an amount or fraction of yttrium oxide, the zirconium oxide making up the larger percentage, especially in view of percent by weight. Within the framework of the instant application, whenever "zirconium oxide" and "yttrium oxide" are mentioned, they are to be considered in broader terms, i.e., as "an oxide of zirconium" and as "an oxide of yttrium".

A good hydrophilic surface condition is achieved by a coating containing or comprised of approximately 80 percent by weight of zirconium oxide and approximately 20 percent by weight of yttrium oxide, in accordance with an additional feature of the invention.

In accordance with yet another feature of the invention, the coating contains or is comprised of approximately 90 to 95 percent by weight of zirconium oxide and approximately 10 to 5 percent by weight of yttrium oxide.

In accordance with yet a further feature of the invention, the coating contains, in addition to zirconium oxide and/or yttrium oxide, one or more of the following substances: CaO, $CeO_2$, MgO, $HfO_2$, $CaF_2$, and $SiO_2$.

Particularly good hydrophilic properties can be obtained with a coating having a surface roughness $R_z$ which is smaller than 5 $\mu$m, and more particularly smaller than 1 $\mu$m, in accordance with yet an added feature of the invention.

In accordance with yet additional features of the invention, the coating is made up of a layer formed by thermal spraying, and more particularly by flame spraying or atmospheric plasma spraying or vacuum plasma spraying, i.e., the coating is applied onto the outer cylindrical surface of the cylinder in accordance with a thermal spraying process.

In accordance with alternative features of the invention, the coating may also be a PVD layer which is applied onto the outer cylindrical surface of a cylinder by physical vapor deposition (PVD layer), or a layer by chemical vapor deposition (CVD layer), by plasma chemical vapor deposition, by sintering, by galvanizing or galvanically, by hot isostatic pressing, or by electron beam physical vapor deposition. It is also conceivable to form the coating by diffusion of zirconium, for example, in that Zr atoms diffuse at a high temperature, thus being oxidized and forming $ZrO_2$.

Furthermore, it is possible to form a layer by laser-caused melting, i.e., the surface is melted and $ZrO_2$ particles are simultaneously added to the melt, for example. According to another alternative, the layer may be formed by enamelling, with $ZrO_2$ particles, for example, added to the enamel composition, which is fired afterwards. It is also possible, in accordance with the invention, to plate steel bodies by blasting or explosive means; for example, metal sheets made of zircalloy 4 may be used, and then subjected to an oxidization treatment, thus forming $ZrO_2$ layers. Although the aforementioned examples refer mostly to the use of zirconium, this does not represent a limitation. Of course, all methods also permit the application of yttrium.

In accordance with a concomitant feature of the invention, the cylinder onto which the coating is applied is made of metal or of plastic material, which may be fiber-reinforced.

Moreover, the invention relates to a novel application of a material or materials which make the surface condition of a printing-machine roller hydrophilic, the material or materials being an oxide of zirconium and/or an oxide of yttrium.

Other features which are considered as characteristic for the invention are set forth in the appended claims.

Although the invention is illustrated and described herein as embodied in a dampening-unit roller of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DETAILED DESCRIPTION OF THE PREFERRED EMBODIMENT

Figure 1:
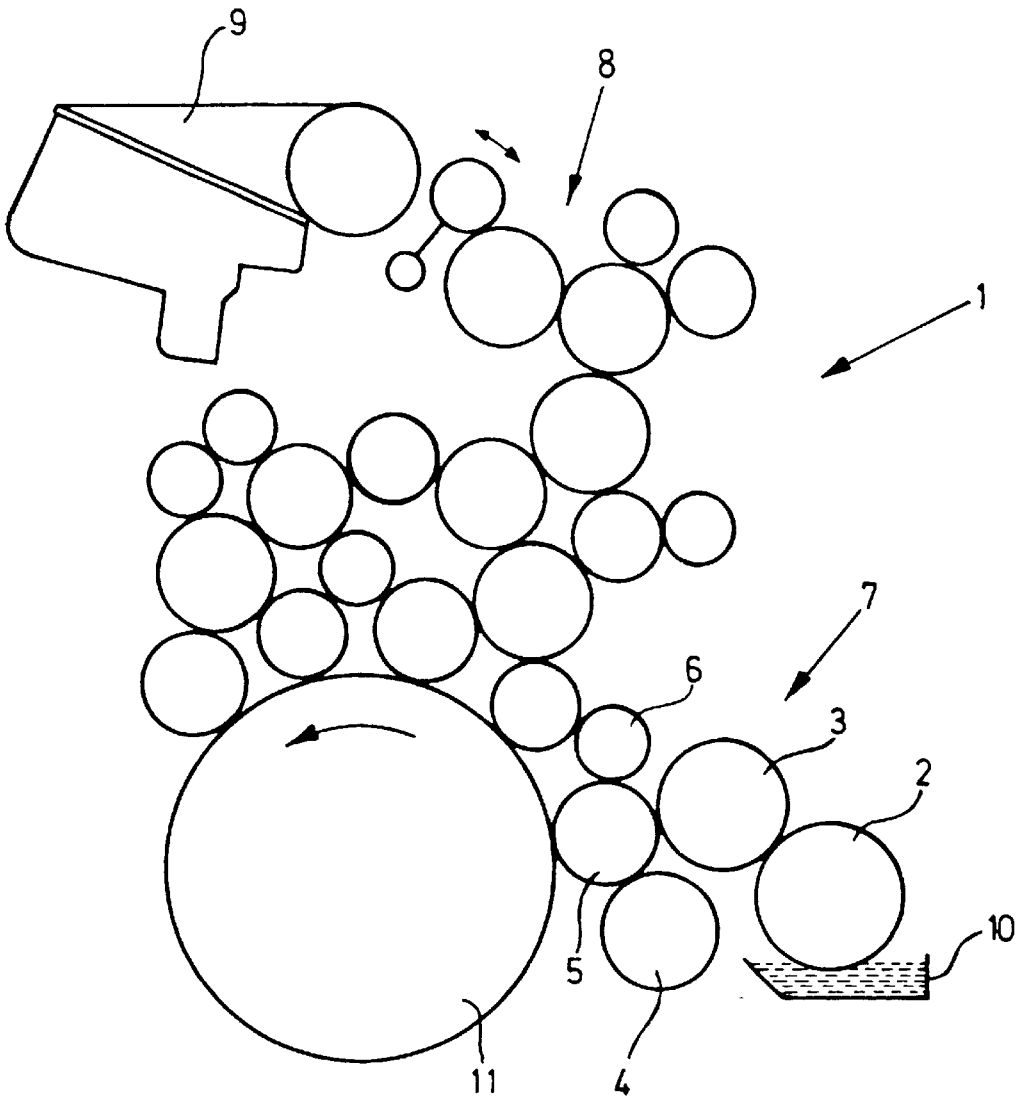
FIG. 1 is a diagrammatic side elevational view of rollers of an offset printing machine.

Referring now to the drawings and, first particularly to FIG. 1 thereof, there is shown therein a roller layout or assembly 1 of a printing unit of an offset printing machine. The rollers 2 through 6 belong to a dampening unit 7, whereas the remaining rollers illustrated in FIG. 1 belong to an inking unit 8. The roller 6 represents an intermediate roller via which the dampening unit 7 and the inking unit 8 are mutually connected. An ink duct or fountain 9 from which printing ink is supplied is assigned to one of the rollers of the inking unit 8. A water pan 10, from which dampening medium (dampening water containing dampening-water additives) is taken and fed to a roller 3 formed as a metering roller, is assigned to the roller 2 of the dampening unit 7 which is formed as a pan or dipping roller. The roller 3 rolls off on the roller 5 which is formed as a rubber-covered roller cooperating with the roller 4 serving as a distributor cylinder. The roller 5 transfers the dampening medium in the form of a thin and uniform film onto a plate cylinder 11 carrying a printing form on the circumference or outer cylindrical surface thereof. In the interest of simplicity and clarity, other rollers or cylinders, such as a blanket cylinder, an impression cylinder and the like are not illustrated in FIG. 1.

At least one of the rollers, namely the metering roller 3, is provided with a coating having excellent hydrophilic properties ensuring an extremely thin and uniform dampening-medium film, thereby avoiding any need for an addition of alcohol or alcohol substitutes, or requiring the use of only considerably reduced fractions of alcohol or alcohol substitutes. Thus, alcohol usually in a concentration of 10 to 15 percent by volume is lowered to an essentially smaller percentage or totally dispensed with. The alcohols which are used are preferably isopropanol or ethanol.

The invention is not limited, however, to the arrangement of rollers of the dampening unit 7 represented in FIG. 1; on the contrary, the invention may be applied to any type of dampening unit.

Figure 2:
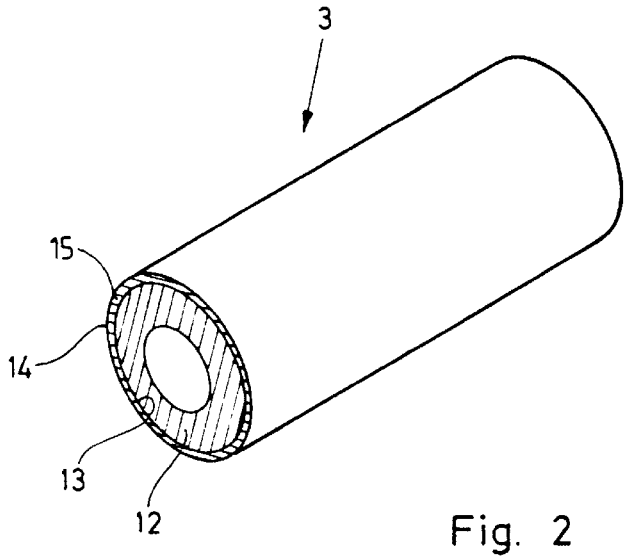
FIG. 2 is a perspective view of a dampening-unit roller severed to show the coating thereon.

FIG. 2 is a perspective view of the roller 3, i.e., the metering roller, which has a hollow cylindrical body 12 made of metal or plastic material, the outer cylindrical surface 13 of which is provided with a coating 14 comprising an oxide of zirconium and/or an oxide of yttrium or consisting of one or both of the oxides. Depending upon the substance and the fraction thereof, on the one hand, and the substances and the fractions thereof, on the other hand, respectively, various embodiments are conceivable.

In the interest of protecting against corrosion and/or promoting adhesion between the surface 13, i.e., the outer cylindrical surface, and the coating 14, an intermediate layer of Ni and/or Cr and/or Al and/or B and/or Si and/or Ti and/or Mo or the like may be applied. The intermediate layer is preferably applied by the aforementioned methods: thermal spraying, physical vapor deposition (PVD), chemical vapor deposition (CVD), plasma chemical vapor deposition or galvanizing.

EXAMPLES a) Very good wetting results are obtained with a coating 14 comprising approximately 80 percent by weight of zirconium oxide and approximately 20 percent by weight of yttrium oxide.

b) According to another example, it is also advantageous if the coating 14 comprises approximately 93 percent by weight of zirconium oxide and approximately 7 percent by weight of yttrium oxide.

c) According to a further example, the coating 14 contains 98 percent by weight of zirconium oxide and 2 percent by weight of yttrium oxide.

d) According to added examples of the invention, the coating 14 may also consist of 100 percent by weight of zirconium or 100 percent by weight of yttrium oxide.

e) Moreover, according to additional examples, the coating 14 may comprise calcium oxide (CaO), cerium oxide ($CeO_2$), magnesium oxide (MgO), hafnium oxide ($HfO_2$), and/or calcium fluoride ($CaF_2$) in addition to zirconium oxide and/or yttrium oxide.

Experiments have shown that, according to example b, for example, a contact angle a of 29 degrees is obtained when the dampening medium contains 0 percent by volume of alcohol. If a dampening medium containing 10 percent by volume of alcohol (isopropanol) is used, the contact angle $\alpha$ is reduced to 20 degrees. The surface roughness $R_z$ of the coating 14 is preferably smaller than 5 $\mu$m. Values which are smaller than 1 $\mu$m are particularly advantageous.

The surface of the coating 14 is preferably treated mechanically, such as by subjecting it to a grinding and/or polishing treatment, particularly. Surface roughnesses $R_z$ of approximately 0.5 $\mu$m in longitudinal direction, i.e., in grinding direction, and of approximately 1 $\mu$m transversely thereto are recommended.

Figure 3:
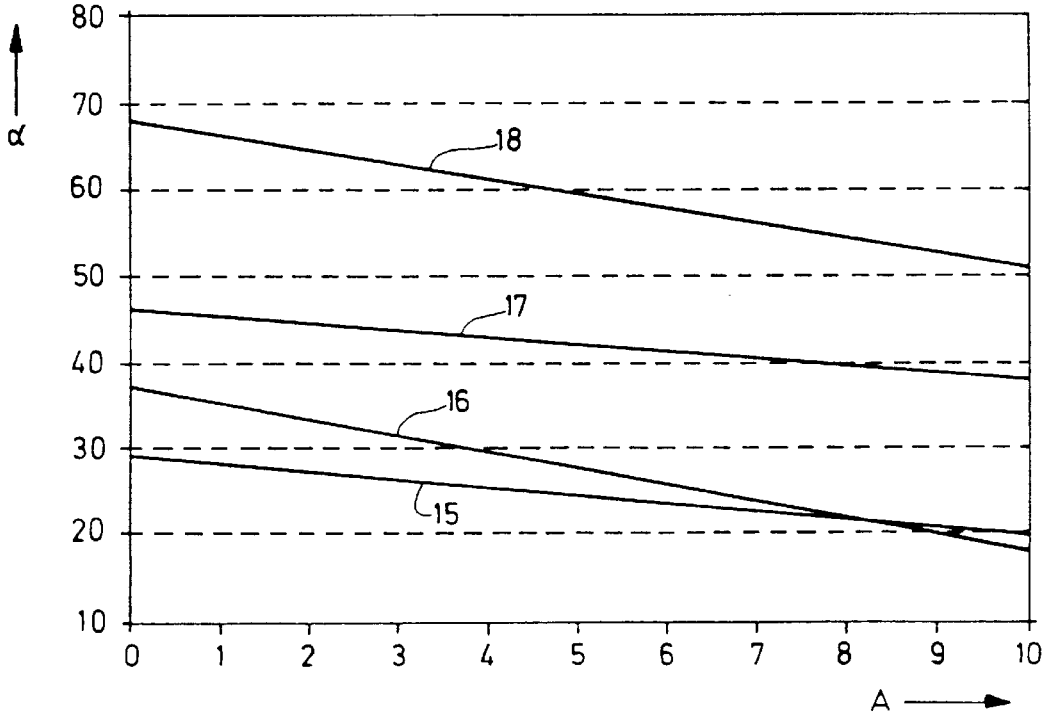
FIG. 3 is a plot diagram of contact angles a as a function of alcohol component A or the like of a dampening medium for various surface conditions of a dampening-unit roller.

The plot diagram of FIG. 3 shows the contact angle a at the surface of the metering roller, i.e., the roller 3, which has a coating according to example b). In the diagram of FIG. 3, the contact angle $\alpha$, given in degrees, is shown as a function of isopropanol content A plotted in percent by volume on the abscissa. With the coating according to the invention, a functional relationship in accordance with the line 15 is produced. The diagram clearly shows an extremely small contact angle $\alpha$, even if no alcohol is added. In contrast therewith, FIG. 3 shows contact-angle values of dampening-unit rollers having conventional surfaces. Thus, the line 16 shows the relationship between the angle $\alpha$ and the isopropanol content A with respect to a silicon-coated roller. The line 17 shows the result produced with a roller such as is disclosed in the aforementioned U.S. Pat. No. 4,991,501. Finally, the line 18 shows the result produced by a dampening-unit roller having a stainless-steel surface.

Various methods are conceivable for applying the coating 14 onto the outer cylindrical surface 13 of the cylinder 12. Advantageously, the following methods may be used: thermal spraying, physical vapor deposition (PVD), chemical vapor deposition (CVD), plasma-chemical vapor deposition, sintering, hot isostatic pressing and galvanizing or electroplating.

The advantage of the coating according to the invention is that it requires no wetting agents, such as alcohol or alcohol substitutes, whatsoever or only very small amounts thereof to be added, yet permitting nevertheless an excellent thin and uniform wetting. A reduced consumption of agents promoting the wetting process is beneficial to the environment. The very thin and uniform dampening-medium film which can be provided in accordance with the invention produces top-grade printing results. Because no additional substances have to be applied to the cylinder surface, no re-hydrophilization is required, quite contrary to the periodic requirement therefor in the case with of the subject matter of the aforementioned U.S. Pat. No. 4,991,501. Thus, offset printing which is of lasting quality and environmentally friendly is possible using very little alcohol or none at all with the very thinnest dampening-medium films.

We claim:

1. Dampening-unit roller for a dampening unit of a printing machine, the roller comprising a roller body having an outer cylindrical surface, and a coating on said outer cylindrical surface, said coating consisting of zirconium dioxide and a stabilizer for said coating selected from the group consisting of CaO, $CeO_2$, MgO, $HfO_2$, $CaF_2$, and $Y_2O_3$.

2. Dampening-unit roller according to claim 1, wherein said coating consists of a zirconium dioxide fraction and said stabilizer is an yttrium oxide fraction, wherein the zirconium dioxide fraction is greater than the yttrium oxide fraction.

3. Dampening-unit roller according to claim 2, wherein said coating consists of approximately 80 percent by weight of zirconium dioxide and approximately 20 percent by weight of yttrium oxide.

4. Dampening-unit roller according to claim 2, wherein said coating consists of approximately 90 to 95 percent by weight of zirconium dioxide and approximately 10 to 5 percent by weight of yttrium oxide.

5. Dampening-unit roller according to claim 1, wherein said coating has a surface roughness $R_z$ smaller than 5 $\mu$m.

6. Dampening-unit roller according to claim 5, wherein the surface roughness is smaller than 1 $\mu$m.

7. Dampening unit roller according to claim 1, wherein said roller body is formed of metal or plastic material.

8. Dampening unit roller according to claim 7, wherein said roller body formed of plastic material is reinforced by fibers.

9. Dampening-unit roller for a dampening unit of a printing machine, the roller comprising a roller body having an outer cylindrical surface, and a coating on said outer cylindrical surface consisting of $ZrSiO_4$.

10. In a method of producing a dampening-unit roller for a dampening unit of a printing machine, wherein the roller has a roller body with an outer cylindrical surface and a coating is applied on the outer cylindrical surface, the improved method which comprises forming a coating consisting of zirconium dioxide and a stabilizer stabilizing said coating.

11. The method according to claim 10, which further comprises forming the coating as a layer formed by thermal spraying.

12. The method according to claim 10, which further comprises forming the coating as a layer formed by plasma spraying or flame spraying.

13. The method according to claim 10, which further comprises forming the coating as a layer formed by a process selected from the group consisting of physical vapor deposition, chemical vapor deposition, plasma chemical vapor deposition, sintering, hot isostatic pressing, galvanizing, electron beam physical vapor deposition, diffusion, and laser-caused melting.

14. The method according to claim 10, which further comprises forming the coating as a sintered layer.

15. The method according to claim 10, which further comprises forming the coating as a galvanically formed layer.

16. The method according to claim 10, which further comprises forming the coating as a layer of enamel to which the zirconium dioxide has been added.

17. The method according to claim 10, which further comprises forming the coating as an explosively plated layer.

18. Dampening-unit roller for a dampening unit of a printing machine, the roller comprising a roller body having an outer cylindrical surface, and a coating on said outer cylindrical surface, said coating consisting of an oxide of zirconium and a stabilizer stabilizing said coating.

19. The dampening-unit roller according to claim 18, wherein said stabilizer is selected from the group consisting of CaO, $CeO_2$, MgO, $HfO_2$, $CaF_2$ and an oxide of yttrium.

20. The dampening-unit roller according to claim 19, wherein said stabilizer is $Y_2O_3$.

* * * * *